United States Patent [19]

Snyder et al.

[11] 4,059,324

[45] Nov. 22, 1977

[54] ELECTRICAL CONNECTOR

[75] Inventors: Gene L. Snyder, Bainbridge; Walter F. Hennessey, Jr., Sidney, both of N.Y.

[73] Assignee: The Bendix Corporation, Southfield, Mich.

[21] Appl. No.: 723,410

[22] Filed: Sept. 15, 1976

[51] Int. Cl.[2] ..... H01R 13/54

[52] U.S. Cl. ..... 339/89 M; 85/81; 339/113 R

[58] Field of Search ..... 339/89-91 P, 339/113 R; 285/81, 82

[56] References Cited

U.S. PATENT DOCUMENTS 2,784,385 3/1957 Ennis ..... 339/89 M 3,901,574 8/1975 Paullus et al. ..... 339/90 R

*Primary Examiner*—Roy Lake
*Assistant Examiner*—E. F. Desmond
*Attorney, Agent, or Firm*—Raymond J. Eifler; Kenneth A. Seaman

[57] ABSTRACT

An electrical connector assembly having a plastic coupling nut 30 and housing 20 that includes an axially extending projection 26 that is mateable with a slot 35 when the coupling nut is threaded to the housing. This arrangement provides pressure on the fully mated threads that restricts uncoupling of the threads when subject to vibration. It also provides visual indication as to whether or not the coupling nut is completely threaded upon the housing.

9 Claims, 2 Drawing Figures

ELECTRICAL CONNECTOR

BACKGROUND OF THE INVENTION

Commonly known types of quick connect and disconnect electrical connectors comprise two parts. Each part consists of a cylindrical shell having within it insulating inserts which contain mating electrical contacts. As the two parts are engaged electrical contacts are also engaged. The connector parts are provided with keys and keyways to properly orient the connector contacts. A coupling device joins and retains the two parts together. Coupling devices include coupling nuts which are threaded or which are of the bayonet type. The connector shells or housings are generally made from aluminum or steel wherein the parts are extruded or machined. When aluminum is used it is coated with cadmium or other suitable plating.

One of the principal uses of quick disconnect electrical connectors is on aircraft where upwards of 100 connectors are used. As with any aircraft component, weight is an important consideration. Obviously, another consideration is the cost of the component. A third consideration is the electrical connector's ability to remain coupled under vibration occurring during flight. Coupling nuts that are threaded and connect together the two halves of a connector assembly are susceptible to decoupling when subject to vibration. Further, when the coupling nut is partially uncoupled the electrical contacts within the connector are partially coupled and in some instances, the contacts are uncoupled. Obviously, poor or broken electrical connections are undesirable. In an aircraft where there are hundreds of connectors, this type of connector makes it easy to visually identify an electrical connector wherein the coupling nut is not completely threaded to a housing.

Accordingly, there has been a need for a light weight, low cost electrical connector assembly that is not susceptible to decoupling when subjected to vibration.

SUMMARY OF THE INVENTION

This invention provides a low cost, light weight electrical connector that is not susceptible to decoupling when subjected to vibration. Visual examination of the connector will reveal whether or not the coupling nut, retaining the two halves of the connector together, is partially or completely connected.

The invention is an electrical connector assembly characterized by a plastic coupling nut 30 and housing 20 that includes on one or the other, an axially extending projection 26 that is mateable with a slot 35 when the coupling nut 30 is threaded to the housing 20 so as to apply axial pressure on the coupling nut. The pressure is applied to the fully mated threads of the coupling nut and housing, this preventing vibration from unthreading the coupling nut. It also provides the advantage that visual inspection of the connector, without uncoupling the connector, immediately identified whether or not the coupling nut is completely threaded upon the housing. The latter advantage is not present in most other connectors of this type because their additional securing mechanism is hidden beneath the coupling nut and cannot be seen. An example of such a prior art connector may be found in U.S. Pat. No. 3,901,574 entitled "Electrical Connector" and issued Aug. 26, 1975 to C. L. Paullus.

Accordingly, it is an object of this invention to provide a low cost, light weight electrical connector that is not susceptible to decoupling when subjected to vibration.

It is another object of this invention to provide an electrical connector that provides visual indication as to whether or not a coupling nut is completely threaded upon a connector housing.

The above and other objects and features of the invention will become apparent from the following detailed description taken in conjunction with the accompanying drawings and claims which form a part of this specification.

DETAILED DESCRIPTION OF THE DRAWINGS

Figure 1:
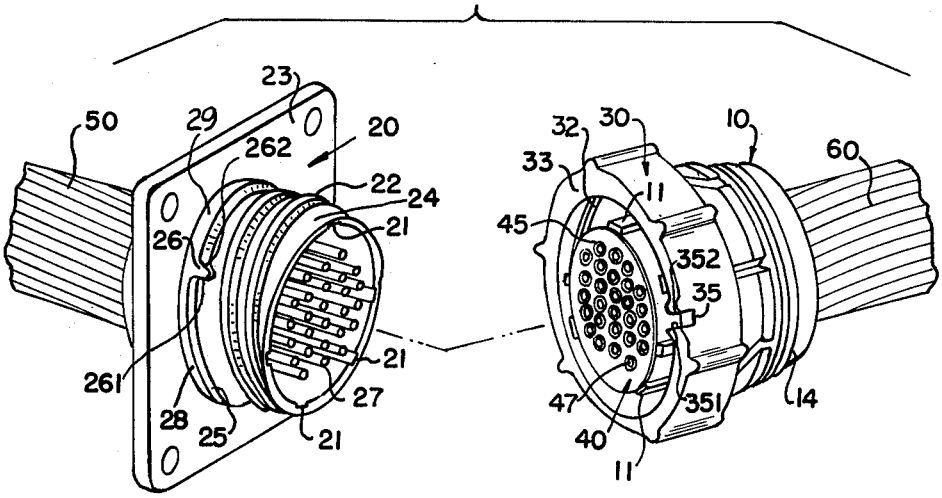
FIG. 1 is an exploded perspective view of the components of an electrical connector incorporating the objects of the invention.

Referring now to the drawings, FIG. 1 illustrates an electrical connector assembly that incorporates the principles of the invention. The electrical connector assembly is comprised of a first shell 10; a second shell 20; a sleeve or coupling nut 30, mounted on one of the shells 10; inserts 40; and a plurality of electrical contacts 27, 47 mounted in the inserts. Preferably, all three pieces are comprised of a firm and resiliently deformable material. A polymeric material can be used and, preferably, the shells 10 and 20 and the coupling nut 30 are comprised of a molded plastic material such as nylon.

One-half of the electrical connector assembly includes a shell 20 having a flange 23 and a tubular portion 24 projecting forwardly away from the flange 23. The tubular portion 24 has on the outside surface thereof threads 22. One end of the threads 22 terminates at a forwardly facing shoulder 25. A forwardly extending projection 26 extends from the shoulder 25. The projection 26 has a rounded side 262 and a flat side 261. A portion 29 of the forward facing shoulder 25, adjacent the rounded side 262 of the projection 26, is spaced further from the flange 23 than a portion 28 of the shoulder, adjacent the flat side 261 of the projection 26. On the inside of the tubular portion 24 of the shell 20 there are a plurality of keyways 21.

Mounted within the shell 20 is a dielectric insert (not shown) that has mounted therein a plurality of electrical contacts 27 that are connected to a plurality of wires 50. The contacts 27 shown are pin type electrical contacts.

The other half of the connector assembly includes a shell 10; a dielectric insert 40; a plurality of electrical contacts 47 mounted within the insert 40; and a coupling nut 30 rotatably mounted on the shell 10. The shell 10 includes threads 14 for receiving a nut 70 (FIG. 2) that retains the coupling nut 30 on the shell 10 and prevents the coupling nut's (30) removal while allowing the coupling nut 30 to rotate. The insert 40 includes a plurality of keys 11 that are designed to mate with the keyways 21 in the other connector shell 20. The insert 40 has a plurality of axial bores 45. Mounted in each of the bores is an electrical contact 47. The electrical contact 47 shown is a socket type contact that is adapted to engage and mate with the pin type electrical contact 27 in the other connector shell 20. The keys 11 and keyways 21, when engaged, orient the contacts in a predetermined manner for mating. Attached to one end of the socket contacts 47 are a plurality of wires 60 which extend from the connector shell 10.

The coupling nut 30 includes, in the front portion, a rearwardly extending notch 35. On one side of the notch 35 there is a rounded projecting portion 352. The other side of the notch 35 includes a flat surface 351 which projects forwardly beyond the forward face 33. The flat side 351 of the notch 35 is adapted to engage the flat surface 261 on the projection 26 of the other shell 20.

Figure 2:
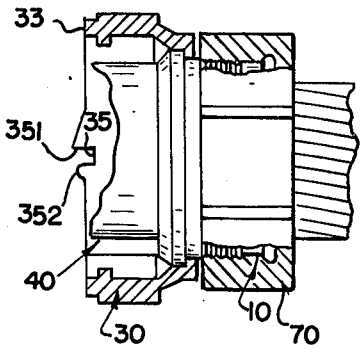
FIG. 2 is a partial cutaway view of one-half of the electrical connector assembly.

FIG. 2 illustrates a diagrammatic and partial cutaway view of the one-half of the connector assembly that includes the coupling nut 30. This view particularly illustrates how the additional threaded nut 70 is threaded onto the rear end of the housing 10 to captivate the coupling nut 30 on the shell 10. This view also illustrates the projection of the flat surface 351 and rounded portion 352 beyond the forward face 33 of the coupling nut 30.

The electrical connector is coupled together in the following manner to accomplish the objects of the invention. The connector shells 10 and 20 are placed in axial alignment with the keys 11 oriented so that they engage the keyways 21. The threads within the coupling nut 30 are engaged with the threads 27 in the other shell 20 and the coupling nut 30 draws the pin contacts 21 and socket contacts 47 together in mated relationship. As the coupling nut 30 approaches being completely threaded with the connector shell 20 the projection 352 on the coupling nut 30 passes over the projection 26 on the shell 20 and projection 26 snaps into notch 35 and surfaces 351 and 261 engage each other thereby preventing further rotation of the coupling nut 30 relative to sleeve 20. In this embodiment, the portion 29, of the forward facing shoulder 25, on one side of the projection 26 is axially wider than the other portion 28 on the other side of the projection 26. This arrangement operates to exert an axial force on projection 352 of the coupling nut 30 thereby applying an axial force to the engaged threads of the coupling nut 30 and housing 20. The projection 26 engaged in notch 35 and, in some instances, the axial pressure on the engaged threads prevents the connector from being uncoupled during vibration. To remove the coupling nut 30 from the housing 20, an extra amount of rotational force in the opposite direction will be required than as required to thread the coupling nut 30 onto the shell 20.

While a preferred embodiment of the invention has been disclosed, it will become apparent to those skilled in the art that changes may be made to the invention as set forth in the appended claims and, in some instances, certain features of the invention may be used to advantage without corresponding use of other features. For example, the location of the notch 35 and projection 26 may be reversed so that the notch is in the housing and the projection would be on the coupling nut. Also, the location of the male and female type electrical contacts may be reversed. Accordingly, it is intended that the illustrative and descriptive materials herein be used to illustrate the principles of the invention and not to limit the scope thereof.

What is claimed is:

1. An electrical connector assembly comprising:

a first shell;

a first insulating insert mounted in said first shell, said insert having a plurality of axial passages therethrough;

a second shell having a forward and rearward portion, thread means on the forward portion of the outside of said second shell, and a forwardly facing shoulder located intermediate of said second shell adjacent the termination of said thread means, said forwardly facing shoulder including a forwardly extending projection;

a plurality of first electrical contacts, each mounted in a respective axial passage in said insert;

a plurality of second electrical contacts mounted in said second shell and adapted to mate with said first contacts; and means for connecting said first and second shells together and holding said pin and socket type contacts together in mated position, said means comprising:

a sleeve rotatably mounted on said first shell, said sleeve having thread means connectable to the thread means on said second shell and a rearwardly extending notch that is adapted to mate with the projection on the forwardly facing shoulder of said second shell, said sleeve being formed of a plastic material which is resiliently deformable to the extent that the sleeve allows the projection on the second shell to mate with the notch in the sleeve, whereby when said first and second electrical contacts are placed in axial alignment and thrust towards each other and said sleeve is rotated in one direction, the threads in said sleeve connect to the threads on said second shell drawing the pin and socket contacts into mated relationship until said projection on said second shell engages the notch in said first shell.

2. An electrical connector assembly as recited in claim 1 wherein said sleeve is comprised of a firm plastic material which is resiliently deformable to the extent that the sleeve allows the projection to mate with the notch.

3. An electrical connector assembly as recited in claim 2 wherein one side of said projection includes a flat surface engageable with a flat surface extending forwardly from one side of the notch in said sleeve.

4. A cylindrical first member adapted to intermate with a cylindrical second member to form an electrical connector, said cylindrical second member including a cylindrical housing having a forward mating face, a plurality of bores opening on said face, each bore adapted to receive an electrical terminal therein, at least one helical groove formed on at least a portion of the outer surface of said housing extending from the forward free end of said housing and terminating adjacent a forwardly facing shoulder, said forwardly facing shoulder including an axially and forwarding extending projection, said first member comprising:

a cylindrical body having a forward mating end adapted to abut said mating face, a plurality of bores opening on said mating end, each bore adapted to receive a mating electrical terminal therein;

a locking ring rotatably and nonslidably mounted on said cylindrical body, said ring having on the inside thereof at least one helical groove adapted to mate with the helical groove on the outer surface of said housing, said locking ring further including on the forward end thereof a rearwardly and axially extending notch that is adapted to mate with the projection on the forwardly facing shoulder of said housing, said ring being formed of a plastic material which is resiliently deformable to the extent that the ring allows the projection on the housing to mate with the notch in locking ring when said locking ring is connected to said housing by the mating of the helical grooves on the locking ring and the housing.

5. An electrical connector as recited in claim 4 wherein one side of said projection includes a flat surface engageable with a flat surface extending forwardly from one side of the notch in said locking ring.

6. A separable electrical connector comprising:

first and second shells connectable in alignment along a common axis;

interfitting keying means on the shells to allow their axial approach and retreat while On rotation relative to each other;

an insulating insert mounted within each shell;

cooperating pin and socket type electrical contacts, said pin contacts mounted in one of said inserts and said socket contacts mounted in said other insert, said pin and socket contacts connectable in mated relationship; and means for connecting and disconnecting the first and second shells together, said means comprising:

a sleeve made of a resiliently-deformable plastic material and rotatably mounted on one of said shells, said sleeve having an axially extending notch in one edge thereof;

means for retaining the sleeve against axial removal in either direction on said one shell; and interfitting thread means in said sleeve and on said other shell;

said other shell including an axially extending projection, adjacent said thread means, adapted to engage the notch in said sleeve when both said thread means are fully engaged, whereby when said first and second shells are placed in axial alignment with said keying means interfitting and said sleeve is rotated in one direction, the threads in said sleeve interfit with the threads on said other shell drawing the pin and socket contacts together in mated relationship until said projection engages said notch, whereby there is visual indication that both thread means are fully engaged.

7. A separable electrical connector as recited in claim 6 wherein one side of said projection includes a flat surface engageable with a flat surface extendin forwardly from one side of the notch in said sleeve.

8. A separable electrical connector comprising:

first and second shells connectable in alignment along a common axis;

interfitting keying means on the shells to allow their axial approach and retreat while preventing rotation relative to each other;

a dielectric insert mounted within each shell;

cooperating pin and socket type electrical contacts, said pin contacts mounted in one of said inserts and said socket contacts mounted in said other insert, said pin and socket contacts connectable in mated relationship; and a sleeve made of a resiliently-deformable plastic material and rotatably mounted on one of said shells for connecting and disconnecting the first and second shells together and holding said pin and socket type contacts together in a mated relationship;

means for retaining the sleeve against axial removal in either direction on said one shell;

interfitting thread means in said sleeve and on said other shell;

a forwardly facing shoulder located intermediate of said other shell adjacent the termination of said thread means; and stop means for preventing further rotation of said sleeve when the thread means of said sleeve are fully mated with the thread means on said other shell, said stop means comprising:

an axially extending notch in one of said sleeve and said forward facing shoulder and an axially extending projection on the other of said sleeve and said forwardly facing shoulder, said projection adapted to engage the notch when said thread means are fully engaged, whereby when said first and second shells are placed in axial alignment with said keying means are engaged and said sleeve is rotated in one direction, the threads in said sleeve engage the threads on said other shell drawing the pin and socket contacts together in mated relationship until said projection engages said notch, whereby there is visual indication that both thread means are fully mated.

9. An electrical connector as recited in claim 8 wherein one side of said projection includes a flat surface engageable with a flat surface extending from one side of the notch.

* * * * *